US011871803B2

(12) United States Patent
Sauer

(10) Patent No.: US 11,871,803 B2
(45) Date of Patent: Jan. 16, 2024

(54) WEARABLE PHYSICAL SHIELD

(71) Applicant: LSI Solutions, Inc., Victor, NY (US)

(72) Inventor: Jude S. Sauer, Pittsford, NY (US)

(73) Assignee: LSI Solutions, Inc., Victor, NY (US)

( * ) Notice: Subject to any disclaimer, the term of this patent is extended or adjusted under 35 U.S.C. 154(b) by 92 days.

(21) Appl. No.: 17/222,701

(22) Filed: Apr. 5, 2021

(65) Prior Publication Data

US 2021/0307417 A1 Oct. 7, 2021

Related U.S. Application Data

(60) Provisional application No. 63/023,431, filed on May 12, 2020, provisional application No. 63/005,143, filed on Apr. 3, 2020.

(51) Int. Cl.

| | |
|---|---|
| ***A41D 13/11*** | (2006.01) |
| ***A41D 13/05*** | (2006.01) |
| ***A42B 3/10*** | (2006.01) |

(52) U.S. Cl.

CPC ..... *A41D 13/1153* (2013.01); *A41D 13/0556* (2013.01); *A41D 13/1161* (2013.01); *A41D 13/1184* (2013.01); *A42B 3/105* (2013.01)

(58) Field of Classification Search

CPC .... A42B 1/04; A42B 3/18; A42B 3/22; A42B 3/24; A42B 3/105; A41D 13/0556; A41D 13/1153; A41D 13/1184; A41D 13/1218; A62B 17/04; A62B 18/04; A64F 9/029; A61F 9/029

See application file for complete search history.

(56) References Cited

U.S. PATENT DOCUMENTS

| | | | | | |
|---|---|---|---|---|---|
| 1,075,906 | A * | 10/1913 | Duncan | A62B 17/04 | 2/424 |
| 1,131,350 | A * | 3/1915 | Engelfried | A62B 17/04 | 2/424 |
| 1,222,995 | A * | 4/1917 | Rhoades | A42B 1/046 | 2/10 |
| 1,872,877 | A * | 8/1932 | Bowers | A62B 18/04 | 128/201.15 |
| 4,017,906 | A * | 4/1977 | Bochynsky | A42B 3/105 | 2/205 |
| 11,583,706 | B2 | 2/2023 | McCoy et al. | | |
| 2003/0033657 | A1* | 2/2003 | Austin | A42B 3/105 | 2/81 |

(Continued)

FOREIGN PATENT DOCUMENTS

| | | | | |
|---|---|---|---|---|
| CA | 2189378 C | * 10/2006 | ..... | A62B 17/04 |
| CA | 3010830 | 7/2017 | | |

(Continued)

OTHER PUBLICATIONS

Scott Kolbe, VisiGuard Face Shield—New Design Released To Protect Essential Work Force, PRWeb ebooks, available as of Apr. 27, 2020.

(Continued)

*Primary Examiner* — Aiying Zhao

(74) *Attorney, Agent, or Firm* — Michael E. Coyne

(57) ABSTRACT

A wearable physical shield is disclosed. The shield includes a visor; a flexible extension coupled to the visor, and a collar coupled to the flexible extension. The visor can include a visor cavity, and the flexible extension can include a flexible (Continued)

extension cavity, wherein a seal is located between the visor cavity and the flexible extension cavity, such that the seal at least partially restricts movement of air between the visor cavity and the flexible extension cavity. The collar is configured to be placed around a neck of a person with a single hand for moving the collar from an open position to a closed position, where first and second arms of the collar are closed around the neck of the person.

17 Claims, 12 Drawing Sheets

(56) References Cited

U.S. PATENT DOCUMENTS

| | | | | |
|---|---|---|---|---|
| 2006/0085881 | A1* | 4/2006 | Gellis | A41D 13/1153 2/9 |
| 2016/0120240 | A1 | 5/2016 | Vanneste | |
| 2017/0100612 | A1 | 4/2017 | Conge et al. | |
| 2018/0084848 | A1 | 3/2018 | Pavalarajan et al. | |
| 2019/0104796 | A1* | 4/2019 | Bacinska | A42B 3/08 |
| 2019/0231005 | A1 | 8/2019 | Jefferis et al. | |
| 2019/0344101 | A1 | 11/2019 | Isham et al. | |

FOREIGN PATENT DOCUMENTS

| | | |
|---|---|---|
| CA | 3011235 | 7/2017 |
| CN | 107713090 | 2/2018 |
| WO | 2015/065750 | 5/2015 |
| WO | 2017/184479 | 10/2017 |
| WO | 2018/082975 | 5/2018 |
| WO | 2018/129195 | 7/2018 |

OTHER PUBLICATIONS

TrueHero, TrueHero—Extreme Coverage Face Shields, https://trueheroshield.com, Apr. 30, 2020, 8 pages.

Google Image Search Results for "visigard face shield", search completed on Apr. 30, 2020.

Visipak Packaging Solutions, Benefits of the VisiGuard Face Shield, 1 page, document saved Apr. 29, 2020.

Raymond J. Roberge, Face shields for infection control: A review, J Ocup Environ Hyg, 2016, 13(4): 235-242, 15 pages, available in PMC Jan. 1, 2017.

* cited by examiner

WEARABLE PHYSICAL SHIELD

RELATED APPLICATIONS

The present application claims the benefit of U.S. Provisional Patent Application No. 63/005,143 filed on Apr. 3, 2020, entitled WEARABLE PHYSICAL SHIELD and U.S. Provisional Patent Application No. 63/023,431 filed on May 12, 2020, entitled WEARABLE PHYSICAL SHIELD. The disclose of both U.S. Provisional Patent Application No. 63/005,143 filed on Apr. 3, 2020 and U.S. Provisional Patent Application No. 63/023,431 filed on May 12, 2020 are hereby incorporated by reference in their entirety.

FIELD

The present disclosure relates to physical barriers, and more specifically to a personal wearable physical barrier used as a protective personal apparatus.

BACKGROUND

Face shields are an element of personal protective equipment devices commonly used by many workers in different fields, such as medical, dental, veterinary, chemical, and construction. Face shields and other supplemental personal protective equipment can be instrumental in the protection of the facial area and associated membranes, for example, the eyes, nose, and mouth. Face shields can protect the user from splashes, sprays, and spatter of bodily fluids and other hazardous materials. Healthcare workers, in particular, often report the body part most contaminated by splatters, splashes, or sprays of bodily fluids is the facial area. However, a recent medical report highlights that little is known about the effectiveness of contemporary face shields and masks at preventing the transmission of, for example, viral respiratory diseases. While a face shield provides barrier of protection against such bodily fluids, there are some disadvantages associated with their use. Facial shields may not be completely protective against airborne exhalants, expelled aerosols, pathogens, or other severe infectious agents.

Currently, typical face shields alone do not completely protect against aerosol contamination or pathogenic or hazardous liquid materials. Current masks over the mouth and nose area, even when used with goggles, face shields and other common devices leave many areas of skin and clothing exposed around the face, head and neck. In particular, face shields are commonly worn along with additive personal protective equipment such as gloves and N95 respirators. The N95 descriptor is used in reference to common facial respirators that are capable of filtering out at least 95% of airborne particles. However, if the user is not careful, they can contaminate a respirator with bodily fluids or other hazardous materials through contact with contaminated hands while adjusting or repositioning their respirator. Common face shields allow clear access of hand to facial contact which can allow for unnecessary contamination and therefore prevent prolonged or repeated use of an N95 respirator. This may be particularly disadvantageous during conditions where such respirators are scarce or in short supply or needed for use with increased numbers of healthcare personnel.

There is a need for an ergonomic combination head and neck shield for providing a barrier against airborne dissemination of liquid, gaseous or particulate contaminants directed towards the front of the user or wearer and also against direct contact of the covered areas by inadvertent touching by the user or another person or thing. Furthermore, there is need for a facial or head shield structure that would complement a suite of personal protective equipment that would be easy to use, comfortable, and provide a barrier against acutely expelled aerosols of body fluids or dust-type particles. There is also a need for a facial shield structure that can easily be put on during a common gowning or protective equipment dressing procedure and useful across a variety of task requirements from patient contact to farming and industrial applications.

SUMMARY

A wearable physical shield is disclosed. The shield also includes a visor; a flexible extension coupled to the visor, and a collar coupled to the flexible extension.

Another embodiment of a wearable physical shield is disclosed. The shield includes a visor with a visor cavity, a flexible extension with a flexible extension cavity, and a seal between the visor cavity and the flexible extension cavity that at least partially restricts movement of air between the visor cavity and the flexible extension cavity.

The wearable physical shield may also include a visor which may include a barrier window. The visor further may include a gasket surface configured to rest against the face of a person wearing the visor, where the gasket surface would contact the person's face above his/her mouth and nose area. The flexible extension may be coupled to the visor along a lower front surface of the visor. The flexible extension may also be sized to cover a protective mask worn by a person when they are also wearing the shield. The collar further may include first and second arms.

The visor is configured to be placed on a person's head with a single hand; and the collar is configured to be placed around said person's neck with said single hand by first grasping the collar while it is held by a first of the one or more positional stops in an open position, moving the collar over said person's neck while the collar is in the open position, and then applying force with said single hand to one or more of the first and second arms of the collar to move the hinge to a second of the one or more positional stops corresponding to a closed position where the first and second arms of the collar are closed around said person's neck.

Figure 1A:
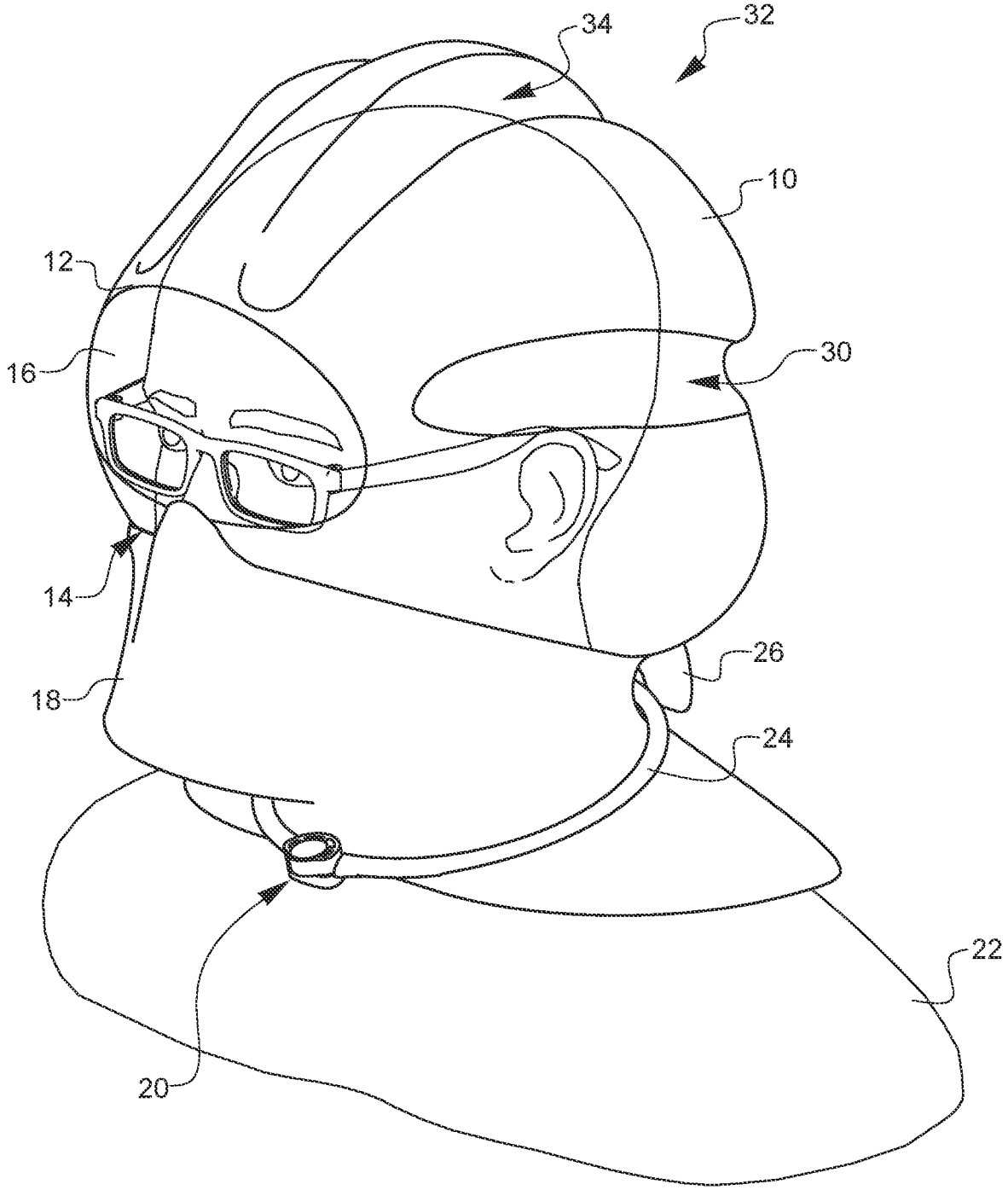
FIG. 1A is a top left front perspective view of a person wearing a wearable physical shield.

It will be appreciated that for purposes of clarity and where deemed appropriate, reference numerals have been repeated in the figures to indicate corresponding features, and that the various elements in the drawings have not necessarily been drawn to scale in order to better show the features.

DETAILED DESCRIPTION

FIG. 1A is a top left front perspective view of a person 22 wearing a wearable physical shield 32. The wearable physical shield 32 is shown placed upon a person's head, neck, and shoulder area as intended for use in one embodiment. The wearable physical shield 32 includes a visor 10, worn over the head, a flexible extension 18 coupled to the bottom edge 14 of the visor 10, and a collar 24 coupled to the flexible extension 18. The visor 10 further defines a barrier window 16 located on the front of the visor 10, two central ribs 34, and a lateral rib 30 located on each side of the visor 10. The visor 10 is shown as a transparent or clear plastic semi-rigid contoured dome. Other embodiments may have portions of the visor 10 that are opaque, translucent, or colored. The barrier window 16 shown in the wearable physical shield 32 is shown as integrated and continuous with the visor 10, however, alternate embodiments may include separate barrier windows such as detachable goggles or other forms of eye protection known to those skilled in the art. The visor 10 has two central ribs 34 and two lateral ribs 30, with one central rib 34 and one lateral rib 30 on each side of the visor. Some of the ribs 34, 30 are not visible in this view. The lateral rib 30 shown may further incorporate a vent, filter, or other opening in alternate embodiments, and other ribs may also incorporate or define vents for providing air ventilation to vent heat or provide protection from a cool environment. Alternate embodiments may include additional or differently placed ribs or vents about the surface of the visor 10.

Coupled to, yet partitioned from, the visor 10 is the flexible extension 18. The flexible extension 18 is a soft fabric drape covering the lower face, neck and upper shoulders of the wearer or user. The flexible extension 18 may also be referred to as a neck cover, gorget, or neck drape, the purpose of which is to cover and protect the lower face, neck and upper shoulders of the user from the spray or splatter of possibly hazardous materials. The flexible extension 18 as shown is a breathable, liquid impermeable synthetic fabric. Alternate embodiments of flexible extension 18 may be constructed of foam, natural fibers or fabrics, or materials with other properties which will be discussed later.

Figure 1B:
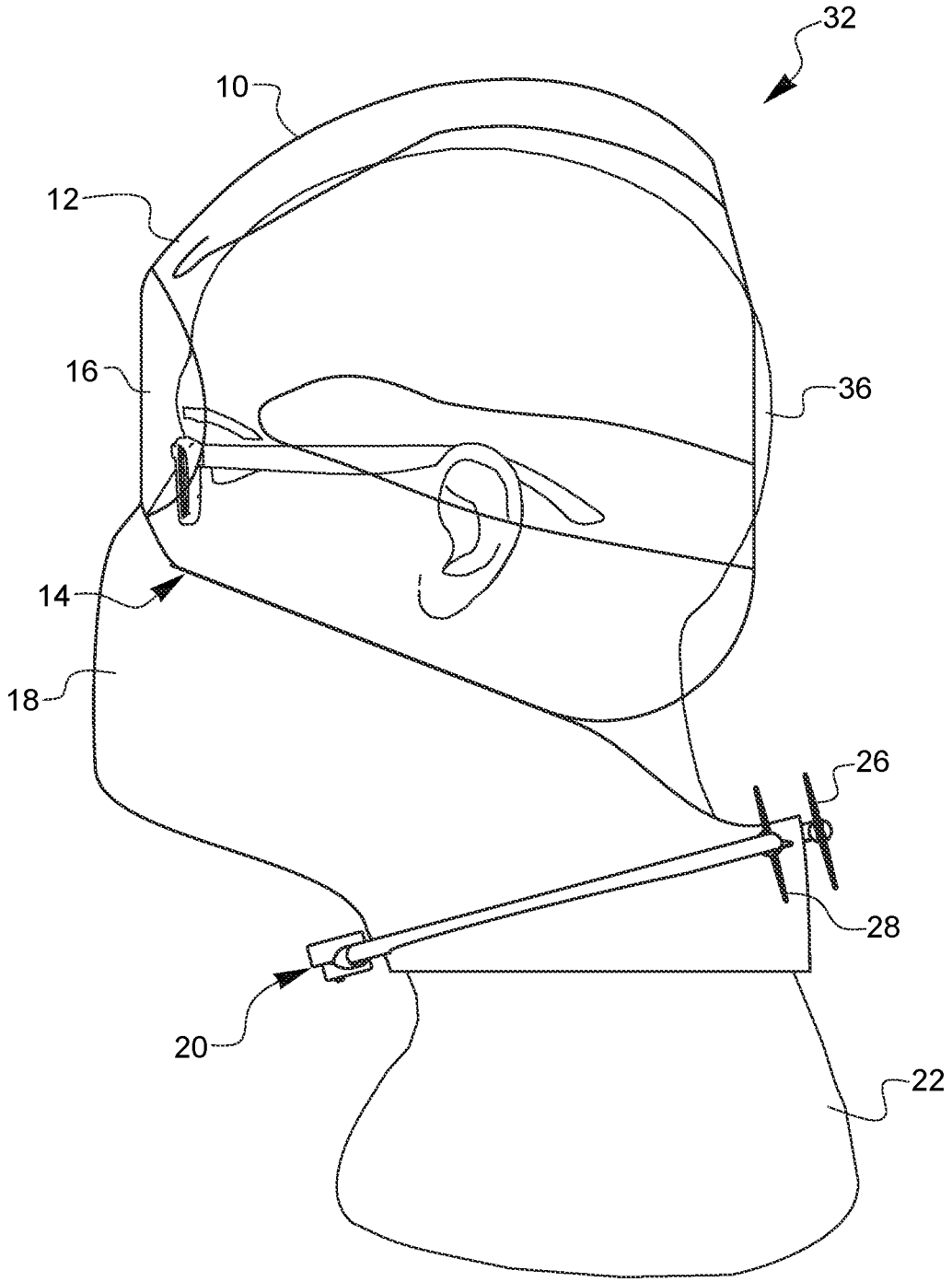
FIG. 1B. is a left side view of the wearable physical shield of FIG. 1A, illustrating where the shield approximates relative to the person's anatomy.

The collar 24 includes a hinge 20 in the front of the wearable physical shield 32 which is fixedly attached to the flexible extension 18 via two paddles 26, 28 located at the back of the collar 24. The attached paddles 26, 28 pull the flexible extension 18 open or closed, as desired, to facilitate single-handed placement of the shield 32 over the head of the user. Opening the back of the flexible extension 18, by separating the paddles 26, 28 from one another, allows the user to place the shield over their head. After the shield 32 is over the user's head, closing the flexible extension 18 by moving the paddles 26, 28 closer together covers the lower face, neck, and upper shoulders of the user. The collar 24 and its function are discussed in more detail later. The paddles 26, 28, located on the collar 24 are illustrated in FIG. 1B. FIG. 1B is a left side view of the wearable physical shield 32 of FIG. 1A, illustrating where the shield 32 approximates relative to the person's 22 anatomy.

The fully assembled wearable physical shield 32 has two partitioned barrier compartment areas which are an upper clear plastic semi-rigid contoured domed visor 10, also referred to herein as a clear shield, and a flexible extension 18 or lower drape, which also be referred to as a neck cover, covering the lower face, neck and upper shoulders. In an embodiment, the collar 24 is the only attachment device to secure the assembly onto the user. In such an embodiment, there is no attachment device on the visor 10 component of the wearable shield 32. The wearable physical shield 32 is provided completely assembled in one embodiment. The wearable physical shield 32 is very light in weight for comfort, storage and disposability.

Individual wearable physical shields 32 may stack within each other for compact storage. The wearable physical shield 32 facilitates adjunctive use under the visor 10 and flexible extension 18 of other personal protective equipment such as surgical or N95 filtering face piece respirator masks, corrective lens glasses, earplugs, surgical caps or hoods with suits. While conventional surgical masks or N95 masks alone may decrease the risk of ventilation exposure and common face shields may be placed in front of the user's face, the conventional products do not cover the forehead or sides of the face well, and provide little or no barriers against dangerous substances beyond the eyes, nose and mouth. If only wearing an N95 mask, for example, the wearer is at risk of facial skin, ear and neck contamination. The assembled wearable physical shield 32 should be waterproof, yet vapor permeable, and strong enough to resist lightweight particle penetration. The wearable physical shield 32 can vent heat and provide some protection from a cool environment. It provides some room for the user's hair or small appliances, light rubber bands or small clips holding the hair. The device is intended to have a friendly appearance, not alien or military-like. Others can see the user's eyes and some facial expressions to minimize any possible threatening impressions on observers of the user. Alternate embodiments of a wearable physical shield 32 include additional features, such as retaining tabs or other securing straps, or similar devices known to those skilled in the art for securing an item against the wearer's head. These retaining tabs or straps can be designed and attached in a manner such that they fold up to accommodate stacking for packaging and storage. This wearable physical shield 32 is intended to allow excellent mobility of the head and neck and to minimize impediments to hearing.

Figure 2:
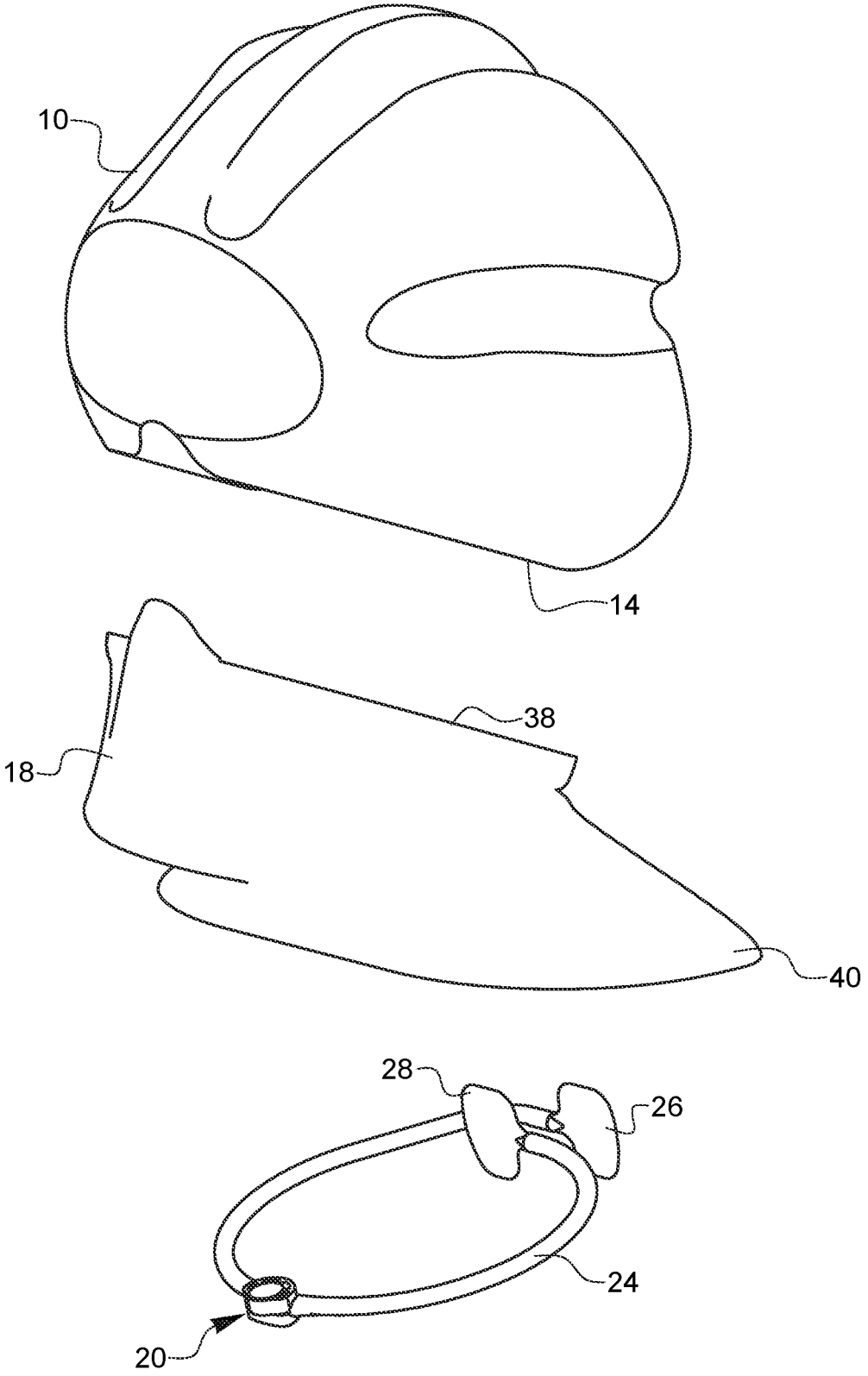
FIG. 2 is an exploded view of the wearable physical shield of FIG. 1A.

FIG. 2 is an exploded view of the wearable physical shield of FIG. 1A. It should be noted that no head is shown in this view for the purposes of clarity. A first paddle 26 and a second paddle 28 are fixedly attached to the rear part of the flexible extension via ultrasonic welding of the fabric flexible extension 32 to the paddles 26, 28 on the collar. The top edge 38 of the flexible extension 18 is fixedly attached to the bottom edge 14 of the clear visor 10 via ultrasonic welding. Alternate embodiments utilize other methods of attachment such as clamps, adhesives, sewing, heat welding, or other methods of attachment known to one skilled in the art.

FIG. 3A-3D are top right front perspective, top view, right side view, and front view, respectively, of a visor 10 of the wearable physical shield 32 of FIG. 1A. The visor 10 is a lightweight, clear plastic, contoured top component of the wearable physical shield 32 covering the bridge of the nose, the eyes, the top and sides of the head, along with both ears. The visor 10 includes internal medial and lateral grooves that run generally from the front to the back of the visor 10 and project radially inward towards the head, thereby defining central, medial, and lateral ribs 30, 34 that define internal vent channels between them throughout the internal area of the visor 10. Internal vent channels, or, the open spaces between the head of the user and the internal surface of the visor 10, which are defined between the described ribs 30, 34, allow for air to circulate from behind the user towards the internal front of the visor 10 and then back outwards to reduce fogging of the integrated clear lens of the barrier window 16 in front of the user's eyes. In addition to allowing movement of exhaled breath, these vent channels also allow heat to vent away during usage. The several central and lateral ribs 30, 34 are defined by the clear visor 10 and traverse from the front of the visor 10 to the back of the visor 10, spaced laterally from side to side across the visor 10. These ribs 30, 34, which may also be referred to as troughs, indentations, or grooves, provide comfort, strength, bending resistance, and stability to the visor 10 and thus to the entire assembled wearable physical shield 32, when worn. The inner surfaces of the ribs 30, 34 are at least partially in contact with the user's head when the shield 32 is worn, and thereby act to center and maintain the wearable physical shield 32 in position on the head. Alternate embodiments include ribs or troughs in an orientation perpendicular to the illustrated ribs 30, 34, running from one side 44 of the visor 10 to the other side 44, to reduce flexing. In another embodiment, a combination of ribs oriented in both directions is used. Any combination of rib arrangement or depth may provide forces in the visor 10 that contribute to holding the visor 10 on the user's head. The illustrated visor 10 is thermoformed from a single sheet of plastic material, but is also, in alternate embodiments, molded or otherwise formed utilizing commonly known plastic fabrication techniques known in the art. Other embodiments may be formed or fabricated in multiple pieces as well. The light weight of the visor 10 is important for comfort, storage, and disposability. While the embodiment described herein is intended to be single use or disposable, the wearable physical shield can alternatively be sterilized and reused. Multiple sizes of the wearable physical shield 32, such as small, medium, and large can be fabricated to cover the adult head size range. Smaller sizes for children are also contemplated. While the visor 10 material is semi-rigid, the material is also partially flexible and is therefore self-adjusting to the contours of the wearer's head. Foam or other padding can be added as needed.

The visor 10 further defines a barrier window 16 or lens located on the front of the visor 10 and is formed continuously with the visor 10. This barrier window 16 is transparent in order for the user to maintain vision while wearing the physical shield 32, while the remaining portion of the visor 10 need not be transparent. The other portions of the visor 10 may be opaque or translucent or formed from a variety of colors. The lens or barrier window 16 is further, in some embodiments, treated, coated, given a layer, or fabricated in such a manner that imparts anti-glare, scratch resistant, fog resistant, anti-fog, light filtering, laser absorbing, polarizing, or other optical properties. The barrier window 16 can be treated or fabricated to exhibit these properties using any of the methods known to one with ordinary skill in the art. The lens or barrier window 16 must not substantially impact visual clarity or limit peripheral vision. In another embodiment, a non-integrated barrier window 16, which is fabricated as a separate body from the visor 10, is removably or fixedly attached to the separately fabricated visor 10. This barrier window 16 is fabricated from clear plastics that are transparent, for example, polycarbonate propionate acetate polyvinylchloride and polyethylene terephthalate glycol (PETG). In additional embodiments, reusable and replaceable window barriers 16 may be used. Foam tapes and other spacing materials are used around the nose and around the head for added support or positioning in some variations.

Figure 3A:
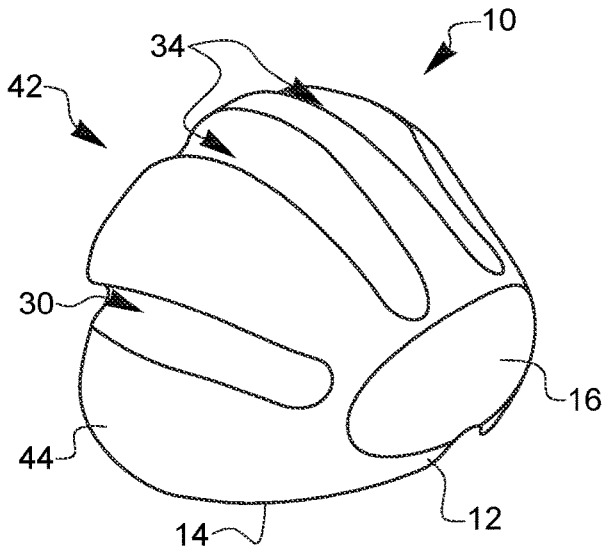
FIGS. 3A-3D are top right front perspective, top view, right side view, and front view, respectively, of a visor of the wearable physical shield of FIG. 1A.
Figure 3B:
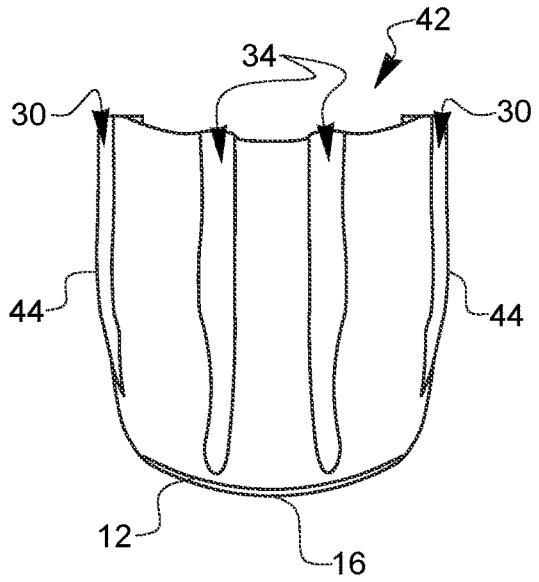
Figure 3C:
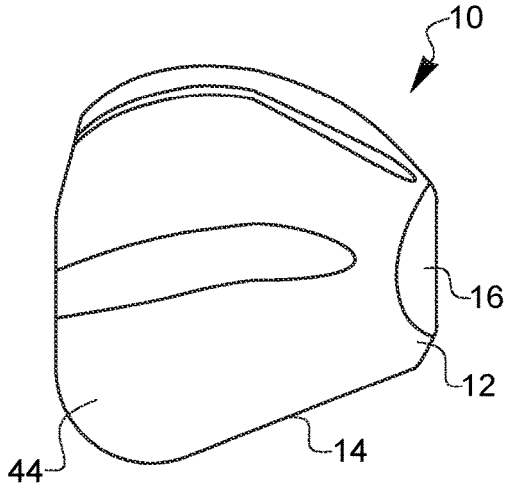
Figure 3D:
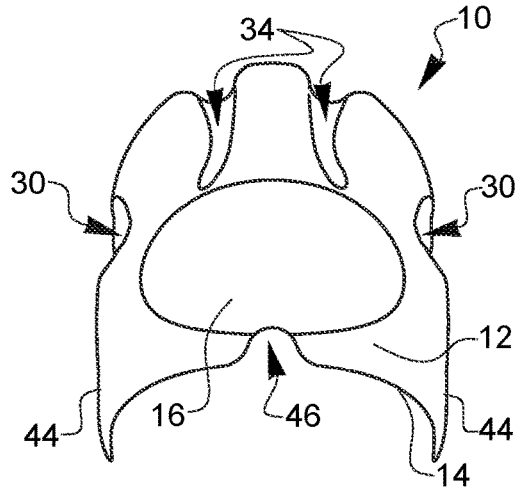

FIG. 3B illustrates the open nature of the back of the visor 10 or helmet. Alternate embodiments of visors 10 are more helmet-shaped, where the body of the visor 10 extends further along the back of the user's head, providing more coverage of the head than the embodiment shown in FIGS. 3A-3D. In such an embodiment, the back of the visor 10 is not open, and the visor more closely resembles a closed dome shape, where the back of the user's head is partially or fully covered by a back portion of the visor 10. Alternatively, in some embodiments, the visor 10 provides less coverage than the embodiment illustrated in FIGS. 3A-D. The visor 10 shown is not configured to cover the mouth of a user, but alternate embodiments include portions that cover the mouth. Alternate embodiments do not cover the ears. It should be noted that any portion of the visor 10 covering the ears should not impede the ability to hear well enough for communication. Gasketing or sealing materials are used to line portions of the visor 10; in particular, there is provided a gasket surface which is fixedly attached to the bottom edge 14 of the visor 10 and configured to rest against the face of a person wearing the visor. This sealing or gasket surface would contact the person's face above the mouth and nose area, providing a full or partial sealing partition between the visor 10 and the neck cover or flexible extension 18. This partial separation between the flexible extension 18 and visor 10 assists in directing air flows in the intended direction through the wearable physical shield 32. This separation between the upper and lower compartments can be further augmented by plastic, foam or flexible sheet material acting as a gasket between the compartments and underlying surfaces like cheeks or other protective devices worn on the user's face. The back part of the visor 10 or clear shield can have either integrated or attached components, such as tabs or bands, that act to hold the wearable physical shield 32 in position on the top of the head. Ratcheted mechanisms to tighten up additional head bands or use of elastic or Velcro straps to further provide adjustability are included in alternate embodiments.

Figure 4A:
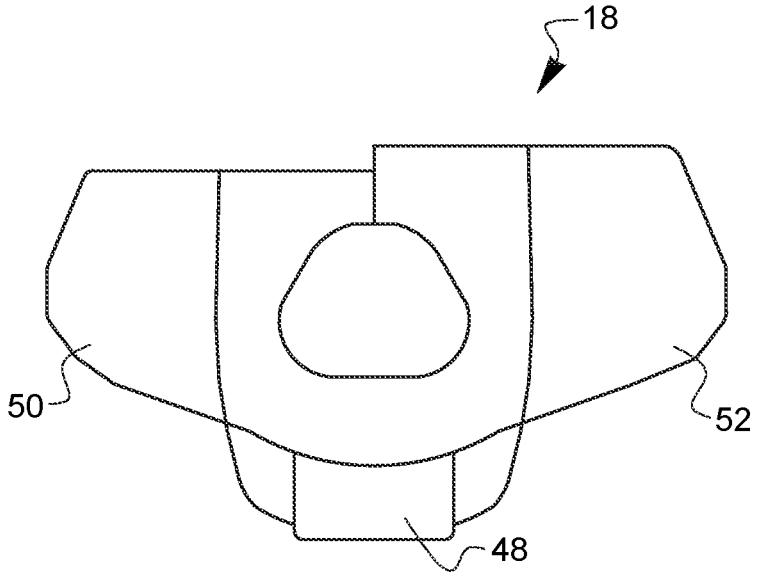
FIGS. 4A-C are top, side, and front views, respectively, of a flexible extension of the wearable physical shield of FIG. 1A.
Figure 4B:
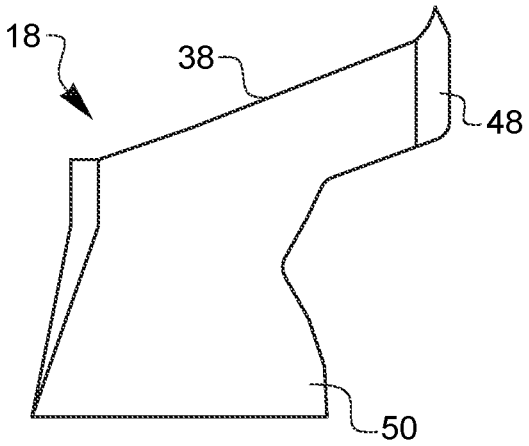
Figure 4C:
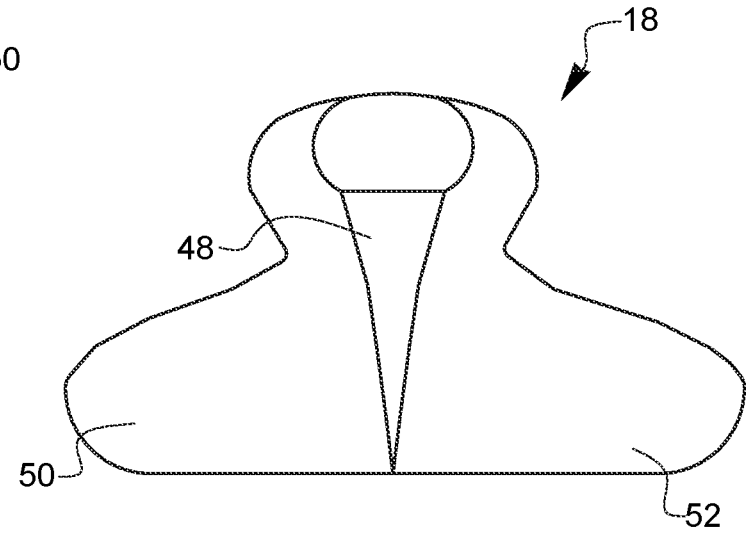

FIGS. 4A-C are top, side, and front views, respectively, of a flexible extension 18 of the wearable physical shield 32 of FIG. 1A. The flexible extension 18 is constructed from a first side segment 50, a front segment 48, and a second side segment 52. The first side segment 50 is coupled, or fixedly attached to the front segment 48 and the second side segment 52 is fixedly attached to the opposite side of the front segment 48. It should be noted that the back or rear portion of the flexible extension 18 is left with an open split extending downwards from the top edge 38 of the flexible extension 18, which allows the flexible extension 18 to be opened by separating the unattached edges along the split, and allows for placing the wearable physical shield 32 over the head of a user.

The flexible extension 18 or neck cover drapes down from the bottom edge 14 of the visor 10 to be placed around the nose and mouth, as well as any mask the user may be wearing, around the chin, over the anterior and sides of the neck, along with the anterior sides and back of shoulders. While the flexible extension 18 or neck cover can be made of one piece in one embodiment, in an alternate embodiment it is made of multiple pieces to accommodate the contours of the human neck, chin, face and shoulders. Other embodiments may include a differently shaped flexible extension 18, a flexible extension 18 formed of a single piece of material, or a combination of both. Other embodiments of a flexible extension 18 may cover the entirety of the user's neck, or be sized to cover the entire neck of the person donning the wearable physical shield 32. The flexible extension 18 or neck cover is constructed of a variety of impermeable comfortable materials, such as close-cell polyethylene foam, Tyvex®, high-density polyethylene fabrics, or other suitable fabrics. Important properties of the flexible extension 18 material include vapor permeability, liquid impermeability, and durability.

Figure 4D:
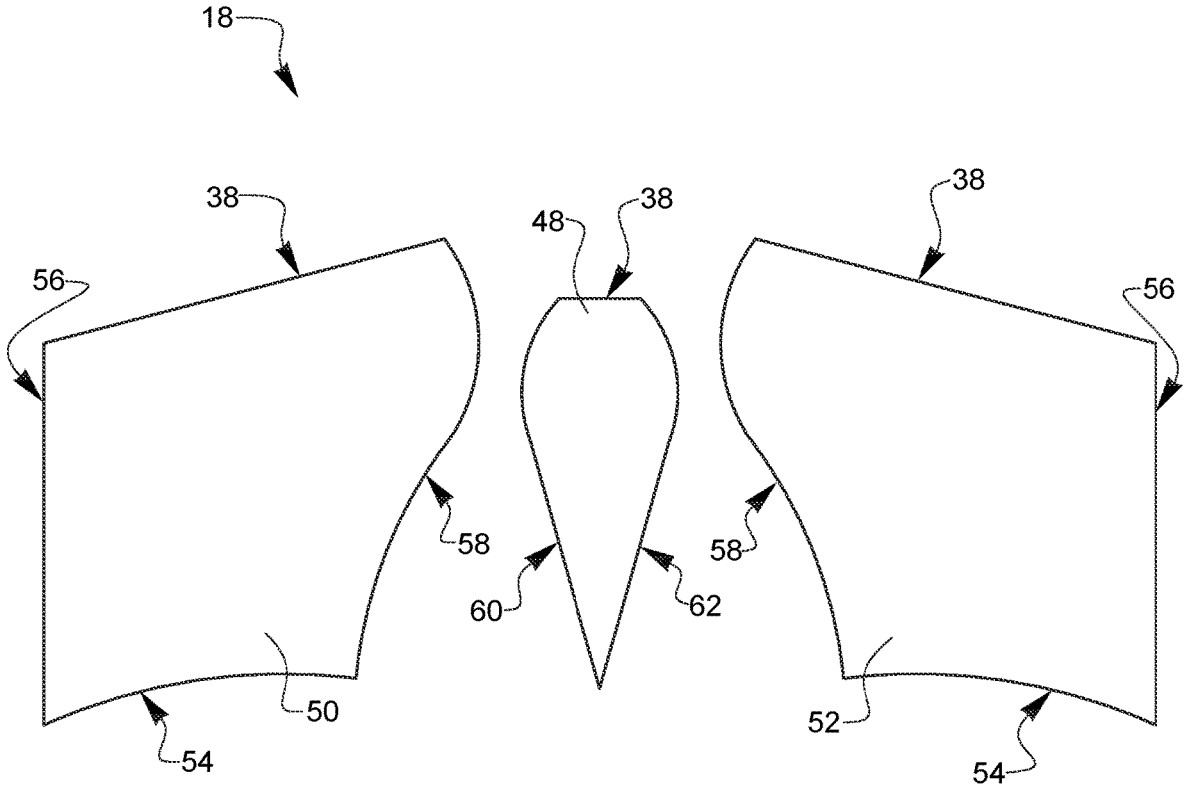
FIG. 4D is a top view of the segments of the flexible extension of FIGS. 4A-4C.

FIG. 4D is a top view of the segments 50, 48, 52 that comprise the flexible extension 18 of FIGS. 4A-4C. The first side segment 50 is fixedly attached by ultrasonically welding an inside edge 58 of the first side segment 50 to a first side edge 60 of the front segment 48. Next, an inside edge 58 of the second side segment 52 is ultrasonically welded to a second side edge 62 of the front segment 48. An outside edge 56 of the first side segment 50 and an outside edge 60 of the second side segment 52 are attached to one or more paddles 26, 28 on the collar. As noted previously, the top edge 38 of the completed flexible extension 18 is ultrasonically welded to the bottom edge 14 of the visor 10. While ultrasonic welding is utilized as an attachment means in this embodiment, other means of adhesion or attachment known to those skilled in the art may be used, such as sewing, clipping, riveting, adhesives, heat welding and other methods.

Figure 5A:
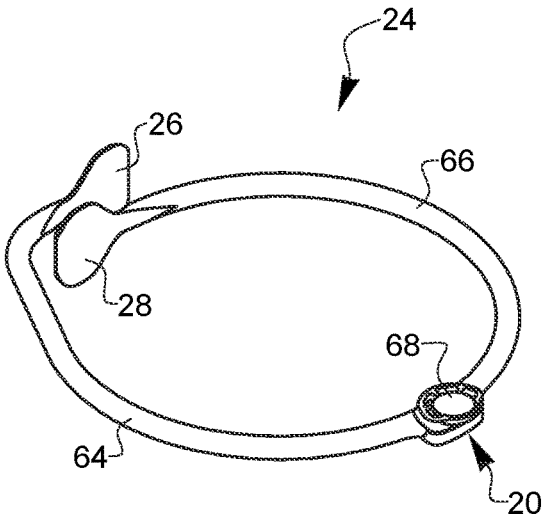
FIGS. 5A-5D are perspective, top, left-side, and front views, respectively, of a collar of the wearable physical shield of FIG. 1A.
Figure 5B:
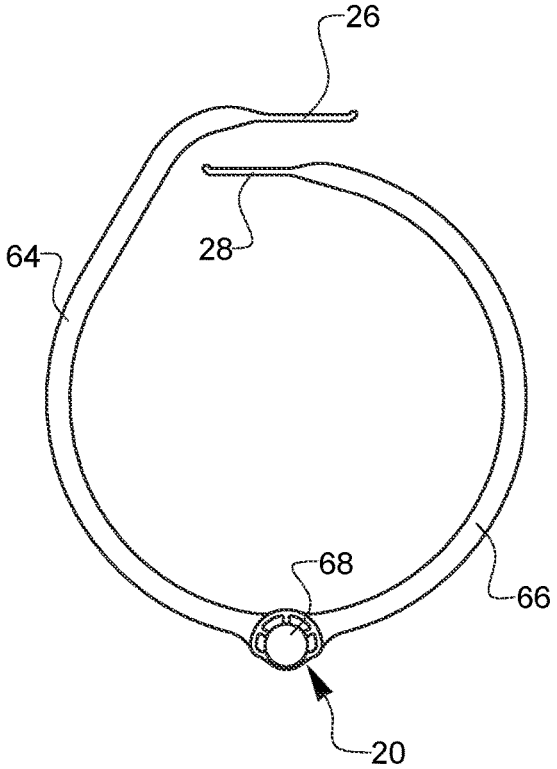
Figure 5C:
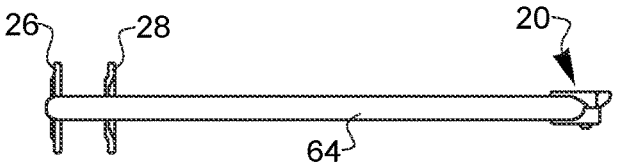
Figure 5D:
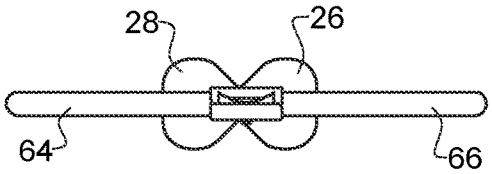

FIGS. 5A-5D are perspective, top, left-side, and front views, respectively, of a collar 24 of the wearable physical shield 32 of FIG. 1A. The collar 24 has a first outer arm 64 with an outer arm paddle 26 on one end and a hinge feature 72 on the opposite end. The first outer arm 64 is arcuate or curved. The collar 24 has a second inner arm 66 which has an inner arm paddle 28 on one end and a hinge feature 74 on the opposite end. The second inner arm 66 is arcuate or curved. Other arm shapes may also be used in either the outer arm 64 or the inner arm 66, such as rectangular or angular, in alternate embodiments. The hinge feature 72 of the first outer arm 64 and the hinge feature 74 of the second inner arm 66 are combined to form a hinge 20 between the first outer arm 64 and the second inner arm 66. The hinge is further connected and pivotably held together with the use of a split rivet pin 68 and several internal features that will be described in further detail. The hinge 20 of the collar 24 enables the outer arm 64 and the inner arm 66 to be connected and movable relative to one another. The paddles 26, 28 on the first outer arm 64 and the second inner arm 66 are attached to outside edges 56 of the flexible extension 18 with the use of ultrasonic welding, although other means of adhesion may be used. Alternate collar 24 embodiments include other structures for holding and moving the flexible extension 18 from an open position to a closed position or vice versa, such as clips or mechanical fastening devices. The collar 24, when attached to the flexible extension 18, will facilitate closure of the shield 32 around the neck. The relative position of the inner arm paddle 66 and the outer arm paddle 64 when the collar 24 is closed as illustrated in FIG. 5B, ensures partial or complete closure of the flexible extension 18 around the back of the user's neck and lower shoulders. In some embodiments, the flexible extension 18 may not be completely sealed, but this allows for exhaled breath to be exhausted below the clear visor 10, which is separated by a gasket in the visor 10 as described previously, through the space between the flexible extension 18 or neck cover and the user's body, towards the back of the user's neck, and vented ultimately out the partially-closed opening between the paddles 26, 28 in the back of the flexible extension 18.

Figure 5E:
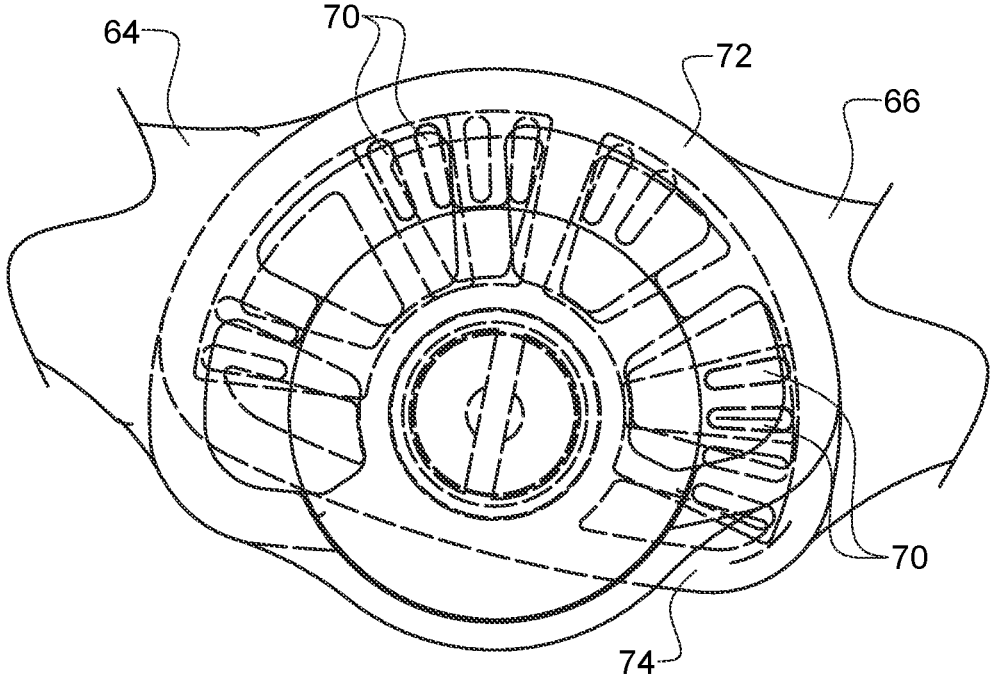
FIG. 5E is a top partial cross-sectional view of a portion of the collar of FIGS. 5A-5D.

FIG. 5E is a top partial cross-sectional view of a portion of the collar 24 of FIGS. 5A-5D. A portion of the outer arm 64 and the attached outer arm hinge feature 72 is shown, as mated with the inner arm hinge feature 74 in a 10° open position. The degrees define an angular displacement about the central axis of the hinge 20. The outer arm hinge feature 72 defines a plurality of tongues 80 and the inner arm hinge feature 74 defines a plurality of complimentary grooves 82 which can mate to form a plurality of positional stops 70 located around a portion of the circumference of the hinge 20, defined by the outer arm hinge feature 72 and the inner arm hinge feature 74. These positional stops 70 are grouped in pairs. The indicated positional stops 70 are engaged in in the position indicated by the view illustrated in FIG. 5E. FIG. 5E is bisected by indicator A.

Figure 5F:
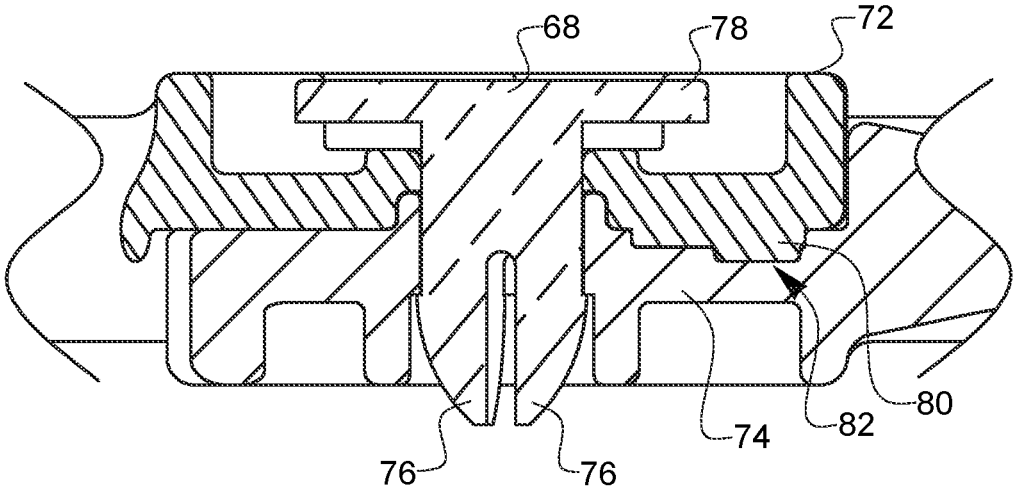
FIG. 5F is a side cross-sectional view of the portion of the collar of FIG. 5E

FIG. 5F is a cross-sectional view of the portion of the collar 24 of FIG. 5E, where the cross-sectional split location is indicated in FIG. 5E by indicator A. FIG. 5F is a partial cross-sectional view which illustrates an isolated positional stop 70. A split rivet pin 68 having a flexure head 78 and two legs 76 rotatably attaches the outer arm hinge feature 72 and the inner arm hinge feature 74 to form the hinge 20 of the collar 24. The inner arm hinge feature 74 further includes a groove 82, which is recessed. The outer arm hinge feature 74 includes a tongue 80 which projects downward into the groove 82. A plurality of tongues 80 mate with a plurality of grooves 82 to reversibly lock the relative position of the inner arm 66 of the collar 24 to the outer arm 64 of the collar 24 into one of the designated positions for the collar 24, as dictated by the relative positions of the tongues 80 and grooves 82. The flexure head 78 of the split rivet pin 68 is in contact with the top surface of the outer arm hinge feature 72, and acts as a spring or biasing element to provide downward pressure onto the outer arm hinge feature 72, thereby exerting downward pressure to hold the outer arm hinge feature 72 against the inner arm hinge feature 74. This biasing pressure holds the hinge features 72, 74 against one another, and thereby holds the tongues 80 of the outer arm hinge feature 72 in the grooves 82 of the inner arm hinge feature 74. When the user moves the collar 24 open or closed, thus changing the relative positions of the outer arm 64 to the inner arm 66, the tongue 80 is forced laterally out of the groove 82, encountering some initial resistance of the sides of the tongue 80 against the walls of the groove 82. Once the tongue 80 is moved with sufficient force, the flexure head 78 of the split rivet pin 68 functions as a spring to allow vertical translation of the hinge features 72, 74 relative to one another to relieve the tongues 80 from the grooves 82 and allow lateral rotation of the tongues 80 relative to the grooves 82. When the collar 24 reaches a position corresponding to the next location of mated positional stops 70, the downward force of the flexure head 78 provides sufficient downward holding force for the collar 24 to maintain the desired position, with the tongue 80 in the next location's corresponding groove 82. In this manner, the hinge 20 and positional stops 70 are configured to hold the collar 24 in either an open position or a closed position.

Figure 6:
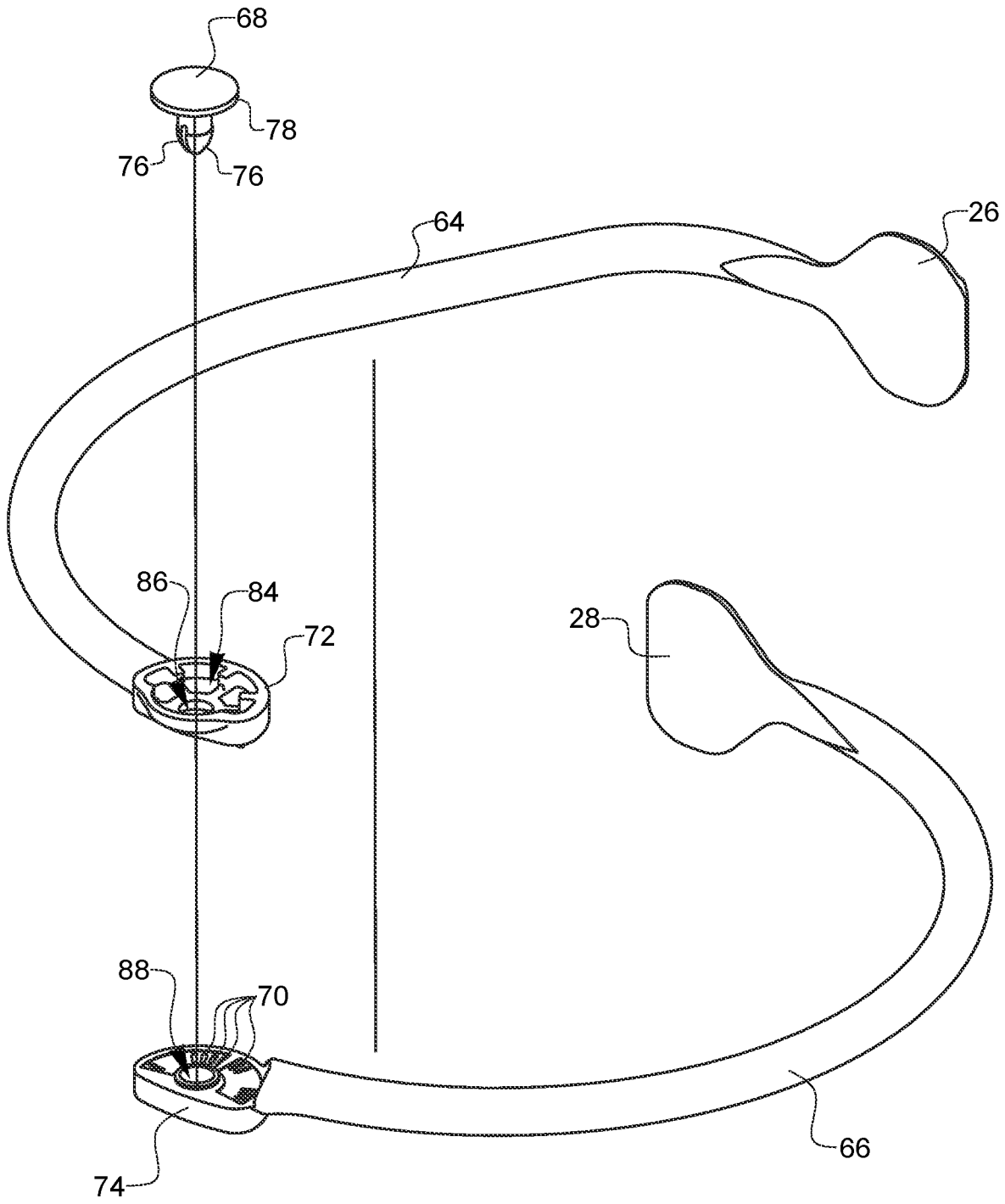
FIG. 6 is an exploded view illustrating assembly steps of the securing collar of FIGS. 5A-5D.

FIG. 6 is an exploded view illustrating assembly steps of the securing collar 24 of FIGS. 5A-5D. The inner arm 66 of the collar 24 defines an inner arm paddle 28 and an inner arm hinge feature 74 having a hole 88 and a plurality of positional stops 70. The outer arm 64 of the collar 24 defines an outer arm paddle 26 and an outer arm hinge feature 72 having a hole 86 and a rivet recess 84. The rivet recess 84 is configured to allow the split rivet pin 68 to rest flush relative to the top surface of the hinge 20 when the split rivet pin 68 is inserted into the hole 86 of the outer arm hinge feature 72 and subsequently into the hole 88 in the inner arm hinge feature 74. While the split rivet pin 68 is used in this embodiment, other methods of hinge configuration and attachment as known to those skilled in the art are used in other embodiments. Once the split rivet pin 68 is inserted, the legs 76 of the split rivet pin 68 pivotably hold the split rivet pin 68 in the assembled hinge 20.

Figure 7A:
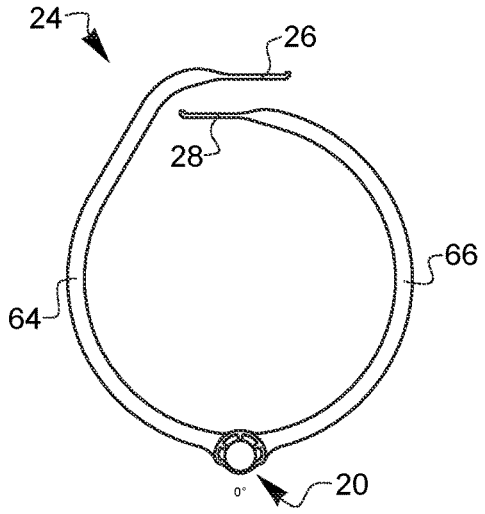
FIGS. 7A-7D are top views of the collar of FIGS. 5A-5D, illustrating various positions of open and closed configurations.
Figure 7B:
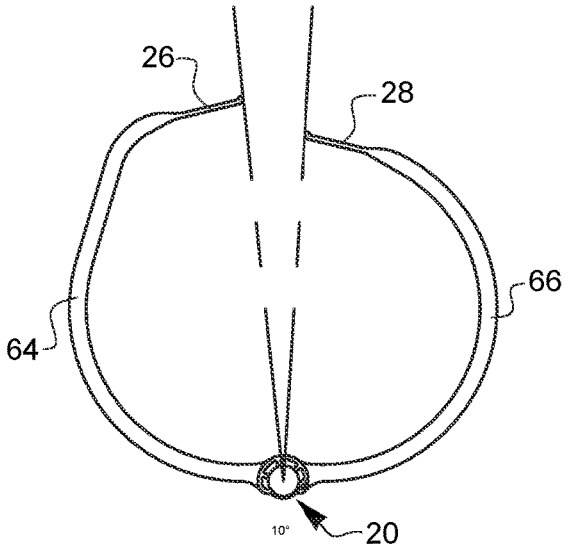
Figure 7C:
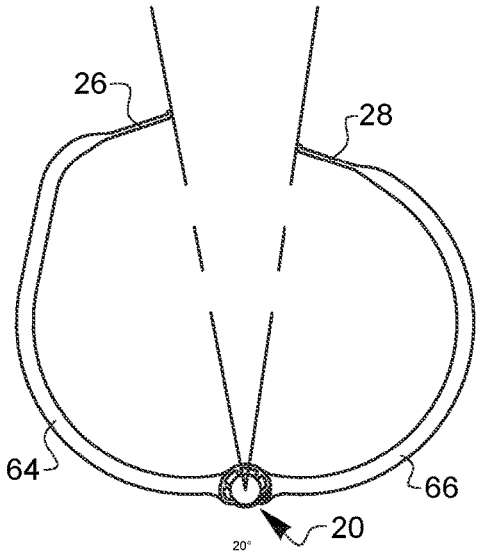
Figure 7D:
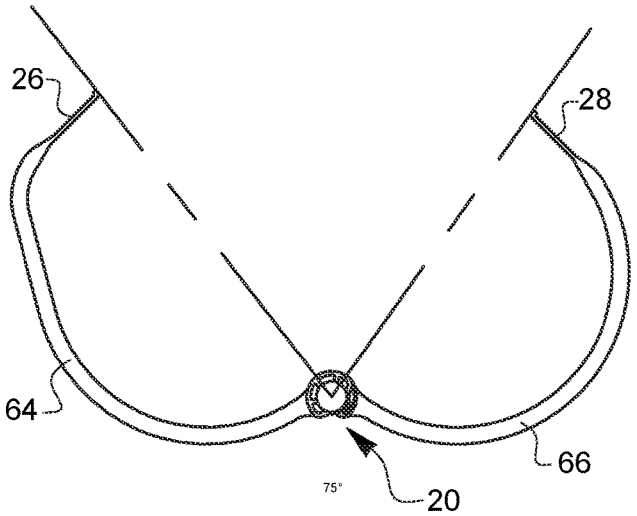

FIGS. 7A-7D are top views of the collar 24 of FIGS. 5A-5D, illustrating various positions of open and closed configurations. FIG. 7A illustrates the collar 24 as fully closed, with the outer arm 64 and inner arm 66 at the closest position relative to one another. The outer arm paddle 26 and inner arm paddle 28 are also at their closest position. This fully closed position would feature the back of the flexible extension 18 fully draped around the back of the neck of the wearer when the wearable physical shield 32 is fully assembled as described previously. FIG. 7B shows the collar in a 10° angular displacement between the arms 64, 66 as measured from the fully closed position (the fully closed position here is defined as 0° displaced), and FIG. 7C shows the collar open to a 20° position, by the same measurement. The angular displacement is measured by rotation about the hinge 20 rotation axis. The positions illustrated in FIGS. 7A and 7B are intended to accommodate anatomical variations in the user, for example, neck size. FIG. 7D illustrates the collar in a fully open position at 75° open, which enables passage of the collar 24 attached to the flexible extension 18 or neck cover over the neck.

The wearable physical shield 32 as described herein can be easily placed in position and removed using only a single hand. The visor 10 portion of the wearable physical shield 32 is configured to be placed on a person's head with a single hand. The integrated collar 24 allows for opening and closing with one or both hands and the collar 24 is configured to be placed around a person's neck by first grasping the collar 24 while it is held in the open position by a positional stop 70 in an open position. The collar 24 is then moved over the person's neck while the collar 24 is in the open position, and then force is applied with the person's single hand to either of the first 64 and second 66 arms of the collar 24 to move the hinge 20 to a second positional stop 70 location corresponding to a closed position where the first 64 and second 66 arms of the collar 24 are closed around the person's neck. This described placement can be reversed to remove the wearable physical shield 32.

The wearable physical shield 32 as described should not only be easy to put on and remove, it should also be relatively inexpensive to manufacture to facilitate short-term utilization and disposability in lieu of cleaning and re-use. Putting on and removing (i.e. donning and doffing) of the wearable physical shield 32 in challenging settings, such as medical settings, can be done easily and quickly under conditions typically encountered and in combination with other associated personal protective products or equipment. The wearable physical shield 32 is put on by pulling it down over the head and closing the collar 24 as described, and it is removed by pulling it back over the head, simultaneously releasing the plastic head tabs, if so equipped, and releasing the collar 24. The wearable physical shield 32 can be placed on a user quickly without any special tools or elaborate techniques. It is lightweight and comfortable as described herein, readily disposable, and enables two-way spoken communication. The wearable physical shield 32 may provide additional protection for wearers of an additional respiratory mask, preventing them from touching a respiratory mask, thereby introducing physical contamination, and enabling prolonged or repeated use of complimentary personal protective equipment worn in concert. The wearable physical shield 32 can be placed on the user by themselves or by others easily to provide protection to both the wearer as well as others in the surrounding area.

Figure 8A:
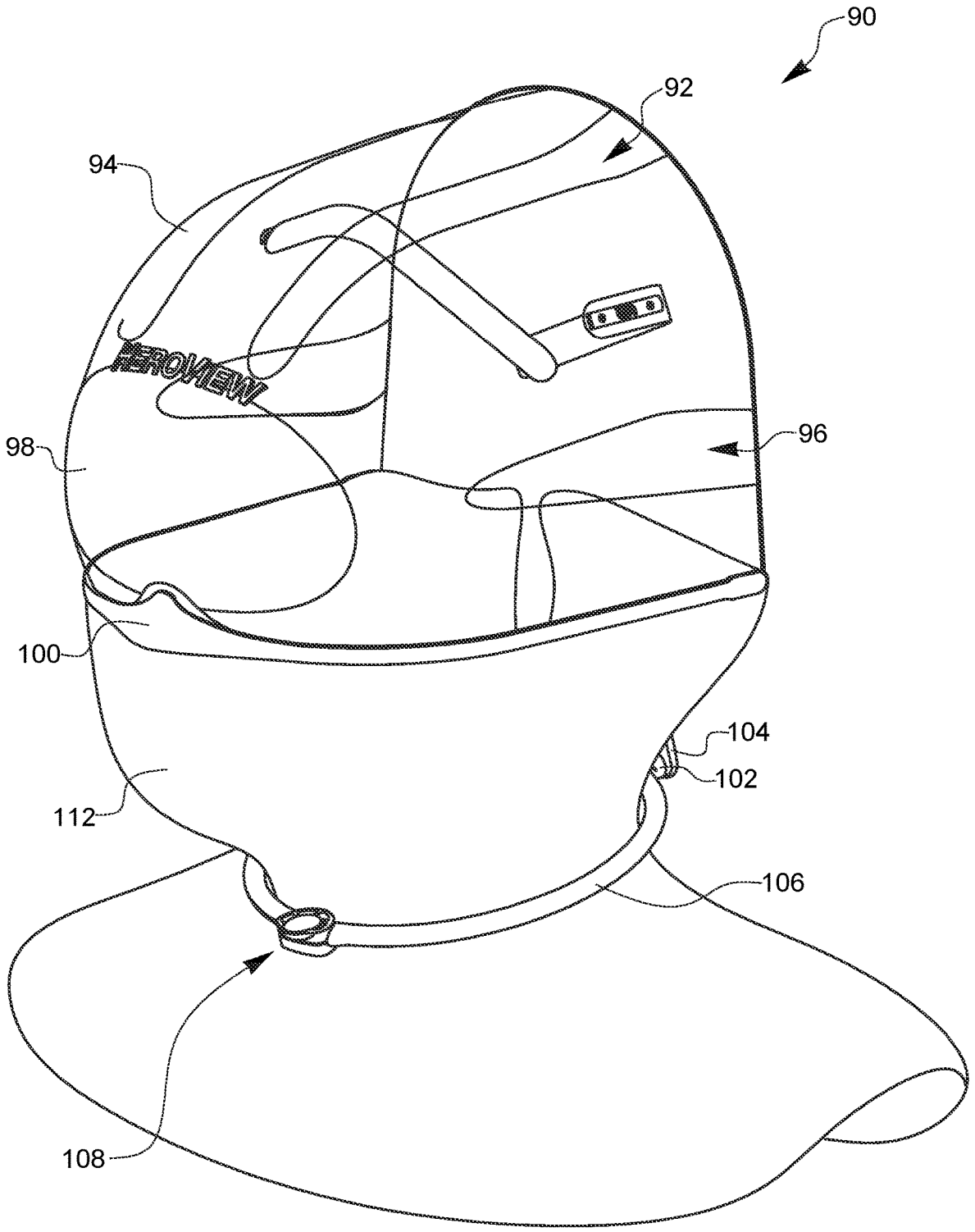
FIGS. 8A-8B are top-left-front and top-right-back perspective views of another embodiment of a wearable physical shield.
Figure 8B:
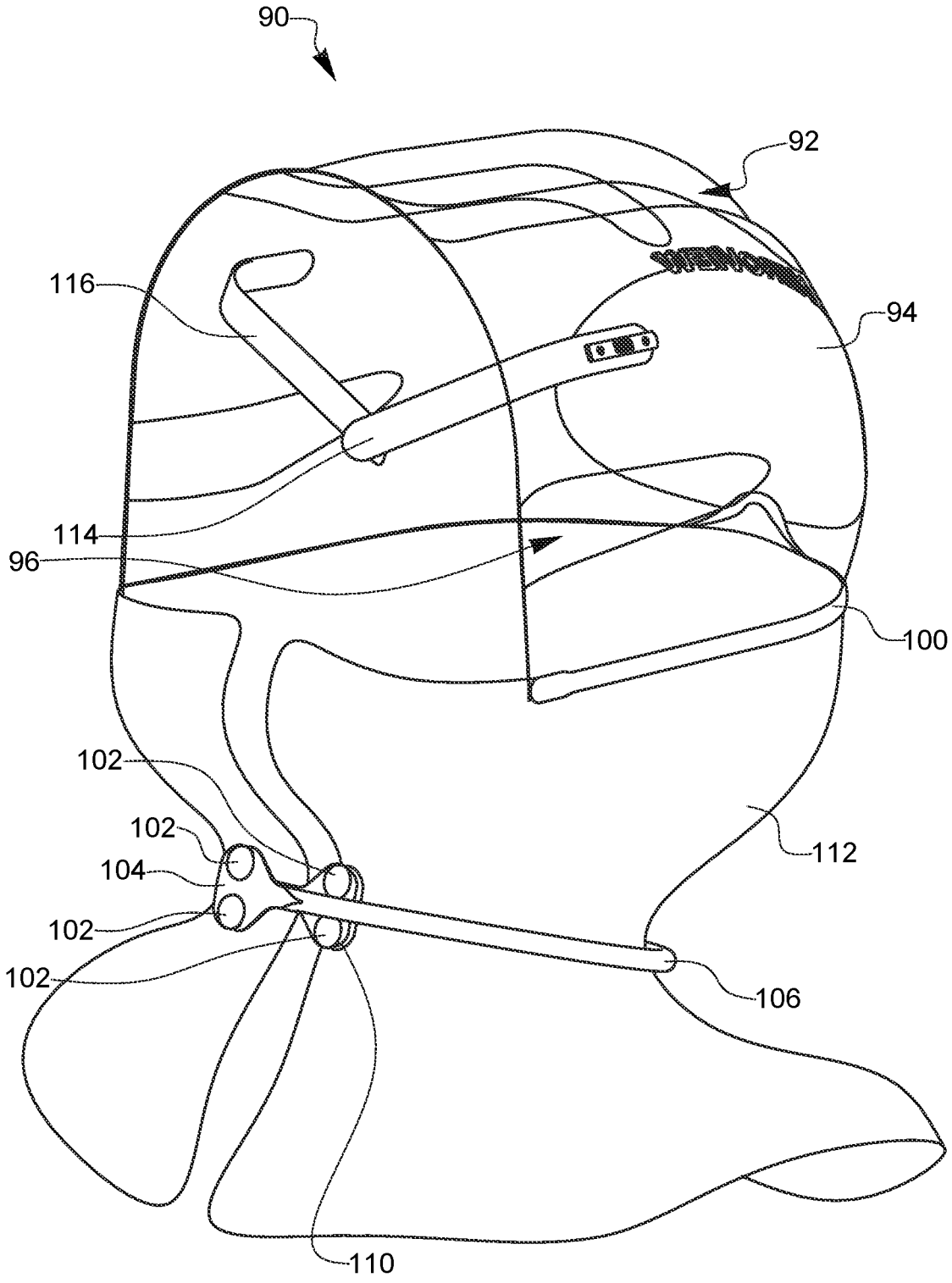

FIGS. 8A-8B are top-left-front and top-right-back perspective views, respectively, of another embodiment of a wearable physical shield 90. FIG. 8A is a top left front perspective view of another embodiment of a wearable physical shield 90. The wearable physical shield 90 is shown in its intended configuration for use. The wearable physical shield includes a visor 94, worn over the head, a gasket 100 on the bottom edge of the visor 94 coupled directly to the visor 94, a flexible extension 112 coupled to the gasket 100 on the bottom edge of the visor 94, and a collar 106 coupled to the flexible extension 112. The gasket 100 may have an inner clip or coupler that affixes either the gasket 100 to the visor 94, the flexible extension 112 to the gasket 100, or both. The gasket 100 may have pins which correspond to holes in the rim of the visor 94. Alternate embodiments may have a gasket 100, visor 94, and flexible extension 112 coupled together by an adhesive, ultrasonic welding, or other attachment means known to those skilled in the art. The gasket 100 is further configured to form a seal on the user's face, and contributes to preventing the user's exhaled breath from fogging up the upper, inner cavity of the visor 94, thereby preventing fog from obstructing the user's vision through a barrier window 98, which is further defined by the visor 94. The visor 94 defines a visor cavity on the interior of the wearable shield 90 which is configured to receive, in one embodiment, the user's upper head, including the eyes, ears, and forehead. The flexible extension 112 also defines a flexible extension cavity on the interior of the wearable shield 90 which is configured to receive, in one embodiment, the lower head of the user, including the nose and mouth. When worn by a user, the gasket 100 presses against the face, creating a seal that at least partially restricts movement of air between the visor cavity and the flexible extension cavity. In this way, the exhaled breath of the user will be at least partially contained to the flexible extension cavity, and will not reach the visor cavity or the barrier window 98, preventing fogging. In other embodiments, the visor cavity covers a larger or smaller portion of the user's head, and the flexible extension likewise will cover a complimentary smaller or larger portion of the user's head. Prevention of fogging may also be reduced or eliminated by the use of a coating or effective anti-fog layer or anti-fogging treatment of the visor 94. One commercial example of such a treatment is Fog Shield® XP, manufactured by Bausch & Lomb. Other examples of anti-fog layers include other surfactants, detergents, coatings, or other hydrophilic coatings such as silicone-based coatings, gelatin, beeswax, and other anti-fog means.

The visor 94 further defines a barrier window 98 located on the front of the visor 94, two central ribs 92, and two lateral ribs 96, with one lateral rib 96 located on each side of the visor 94. The visor 94 is ideally constructed as a transparent or clear plastic semi-rigid contoured dome.

Other embodiments may have portions of the visor 94 that are opaque, translucent, or colored. The barrier window 98 shown in the wearable physical shield 90 is shown as integrated and continuous with the visor 94, however, alternate embodiments may include separate barrier windows 98 such as detachable goggles and other forms of eye protection known to those skilled in the art. The two central ribs 92 and two lateral ribs 96 serve a dual purpose of holding the shield 90 in position relative to the side or top of a user's head, as well as providing an internal ventilating structure that conducts exhaled breath from a user's mouth towards the back of the visor 94. The lateral ribs 96 further incorporate a vent in alternate embodiments, and other ribs may also incorporate or define vents for providing air ventilation, to vent heat or to provide protection from a cool environment. Alternate embodiments include additional or differently placed ribs or vents about the surface of the visor 94.

Coupled to yet partitioned from the visor 94 is the flexible extension 112. The flexible extension 112 is a soft fabric drape covering the lower face, neck and upper shoulders of the wearer or user. The flexible extension 112 may also be referred to as a neck cover, gorget, or neck drape, the purpose of which is to cover and protect the lower face, neck and upper shoulders of the user from the spray or splatter of possibly hazardous materials. The flexible extension 112 as shown is a breathable, vapor permeable, liquid impermeable synthetic fabric. Alternate embodiments of the flexible extension 112 are constructed of foam, natural fibers or fabrics, or materials with other properties. The collar 106 includes a hinge 108 in the front of the wearable physical shield 90 which is fixedly attached to the flexible extension 112 via two paddles 104, 110 located at the back of the collar 106. The attached paddles 104, 110 pull the flexible extension 112 open or closed, as desired, to facilitate single-handed placement of the shield 90 over the head of the user. Opening the back of the flexible extension 112 allows the user to place the shield 90 over their head, and once the shield has been placed on the head of the user, closing the flexible extension 112 completely covers the lower face, neck, and upper shoulders of the user. The paddles 104, 110 coupled to the collar 106 are illustrated more clearly in FIG. 8B. Several rivets 102 are shown on each of the paddles 104, 110. The rivets 102 are placed through the paddles 104, 110 and portions of the flexible extension 112 for the purpose of coupling the flexible extension 112 to the collar 106. Other embodiments have the flexible extension 112 coupled to the collar 106 with the use of other attachment means, such as ultrasonic welding, heat welding or adhesives. It should be noted that any attachment means known to one skilled in the art can be used in other embodiments. FIG. 8B is a top-right-back perspective view of the wearable physical shield 90 of FIG. 8A. Also illustrated in FIG. 8B are a first head spring clip 116 and a second head spring clip 114 coupled to the visor 94. These head spring clips 114, 116, also known as retention clips, are configured to fold inward for efficient stacking of the wearable physical shield during a storage or shipping configuration, yet are also able to fold out to secure the wearable physical shield 90 on a user's head. The stiffness of the material forming the head spring clips 114, 116 provides a resistance fit onto the head of the wearer once unfolded, in the orientation shown in FIG. 8B. The retention clips 114, 116, in alternate embodiments, may have hook and latch type fastening tape or other fastening means on the outer ends of the retention clips 114, 116 such that the two retention clips 114, 116 can be releasably fastened to one another, providing additional holding security upon a user's head.

Other embodiments incorporate a comfort barrier or temperature control element coupled to a back portion of the visor 94, flexible extension 112, or collar 106. A comfort barrier may include a cooling element or heating element in direct or indirect contact with the wearer. There may be perforations in the flexible extension 112 layer to facilitate transmission of heating or cooling energy from the heating or cooling element towards the user. The cooling or heating may be active via the use of battery or energy powered sources known in the art or may be passive, such as a disposable stick-on cooling or heating pad. This single unit configuration facilitates an easy on/easy off operation which is aligned on the user's head, provides anti-fog features for consistent and prolonged visual clarity, vents away exhaled breath, and also enables a comfortable temperature for the user. Other embodiments may include adhesives on the lower portion of the flexible extension 112 like magnets, tape, or other adherent for adequate sealing and coverage. The posterior area of the unit may have additional inserts for enhanced filtration, such as an N95 filter, or other secondary features. Embodiments include a visor 94 fabricated as a single molded article, from a material such as, in one embodiment, polypropylene (PP). Additionally, in some embodiments, one or more pieces may be molded separately, or as one or more parts as a molded subassembly, utilizing, for example, glycol modified polyethylene terephthalate (PETG), polypropylene (PP), or polyethylene (PE) foam sheet.

Thus, it is contemplated the barrier window 98 can be formed continuously with the visor. In addition, the barrier window 98 can light filtering and/or light polarizing and include at least one of a scratch resistant layer, an anti-glare layer, an anti-fogging layer. As set forth above, the visor 10, 94 can comprises a single thermoformed sheet of material. Further, the flexible extension 18, 112 can include a fabric, such as a high-density polyethylene. Further, the flexible extension 18, 112 can include a vapor permeable material or a liquid impermeable material. Depending on intended operating parameters, the shield 32, 90 can comprise a single molded article.

Various advantages of a wearable physical shield 32, 90 for use as a protective personal apparatus have been discussed above. Embodiments discussed herein have been described by way of example in this specification. It will be apparent to those skilled in the art that the foregoing detailed disclosure is intended to be presented by way of example only, and is not limiting. Various alterations, improvements, and modifications will occur and are apparent to those skilled in the art, though not expressly stated herein. These alterations, improvements, and modifications are intended to be suggested hereby, and are within the spirit and the scope of the claimed invention. The drawings included herein are not necessarily drawn to scale. Additionally, the recited order of processing elements or sequences, or the use of numbers, letters, or other designations, is not intended to limit the claims to any order, except as may be specified in the claims. Accordingly, the invention is limited only by the following claims and equivalents thereto.

What is claimed is:

1. A shield configured to protect at least a portion of a head of a user, the shield comprising:

a visor comprising a clear or translucent shell configured to cover a bridge of a nose, eyes, a top and sides of the head, and both ears of the user, the visor comprising:

a clear barrier window disposed on a front portion of the visor corresponding to a position of the eyes of the user such that the user looks through the clear barrier window when wearing the shield; and a plurality of elongated ribs defined by corresponding portions of the visor, each of the plurality of ribs extending inward towards the head of the user such that a portion of each of the plurality of ribs contacts a corresponding portion of the head of the user, the plurality of ribs cooperating to define an internal vent channel between adjacent ribs of the plurality of ribs, with the internal vent channel configured to allow for air to circulate from behind the user towards an internal front of the visor and then back outwards to reduce fogging of the barrier window;

a flexible extension coupled to a bottom edge of the visor, the flexible extension comprising a fabric material configured to cover a portion of a lower face of the user and a portion of a neck of the user; and a collar configured to be positioned around the neck of the user around a portion of the flexible extension to secure the flexible extension to the neck of the user, the collar comprising:

first and second arms; and a hinge between the first and second arms, wherein the hinge comprises two or more positional stops, and wherein the collar is configured to be placed around the neck of the user with a single hand by first grasping the collar while the collar is held by a first of the two or more positional stops in an open position, moving the collar over the neck of the user while the collar is in the open position, and then applying force with the single hand to one or more of the first and second arms of the collar to move the hinge to a second of the two or more positional stops corresponding to a closed position where the first and second arms of the collar are closed around the neck of the user.

2. The shield of claim 1, wherein the visor is free of an attachment device directly coupled to the visor and configured to engage the head of a person wearing the shield.

3. The shield of claim 1, wherein:

the visor is open on a back portion of the visor opposite from the barrier window.

4. The shield of claim 1, wherein the visor is not configured to cover a mouth of the user.

5. The shield of claim 1, wherein the visor further comprises a gasket surface configured to rest against the face of a person wearing the shield, wherein the gasket surface is configured to contact the face of the person wearing the shield above a mouth and nose area of the person.

6. The shield of claim 1, wherein the flexible extension is ultrasonically coupled to the visor.

7. The shield of claim 1, wherein the flexible extension is ultrasonically coupled to the collar.

8. The shield of claim 1, wherein the flexible extension is comprised of one or more segments.

9. The shield of claim 1, wherein the flexible extension is sized to cover a protective mask worn by the user when the user is also wearing the shield.

10. The shield of claim 1, wherein the flexible extension further comprises an adhesive.

11. The shield of claim 1, wherein the collar is coupled to the flexible extension on an outside surface of the flexible extension.

12. The shield of claim 1, wherein the first and second arms are arcuate.

13. The shield of claim 1, wherein the first and second arms are movable relative to each other.

14. The shield of claim 1, wherein at least one of the two or more positional stops is configured to hold the collar in an open position.

15. The shield of claim 1, wherein at least one of the two or more positional stops is configured to hold the collar in a closed position.

16. The shield of claim 1, wherein the shield is configured to be placed on the head of the user with a single hand of the user.

17. The shield of claim 1, further comprising retention clips coupled to the visor.

* * * * *